US010542798B2

(12) United States Patent
D'Abundo

(10) Patent No.: US 10,542,798 B2
(45) Date of Patent: Jan. 28, 2020

(54) BUOYANT SUPPORT FOR AN OBJECT

(71) Applicant: Gianmanuel D'Abundo, Berlin (DE)

(72) Inventor: Gianmanuel D'Abundo, Berlin (DE)

( * ) Notice: Subject to any disclaimer, the term of this patent is extended or adjusted under 35 U.S.C. 154(b) by 0 days.

(21) Appl. No.: 15/329,010

(22) PCT Filed: Jul. 29, 2015

(86) PCT No.: PCT/DE2015/100319

§ 371 (c)(1),
(2) Date: May 12, 2017

(87) PCT Pub. No.: WO2016/015718

PCT Pub. Date: Feb. 4, 2016

(65) Prior Publication Data

US 2017/0251774 A1 Sep. 7, 2017

(30) Foreign Application Priority Data

Jul. 30, 2014 (DE) ..... 10 2014 011 481

(51) Int. Cl.

| | |
|---|---|
| ***B63B 22/00*** | (2006.01) |
| ***A45B 11/00*** | (2006.01) |
| ***A45B 25/00*** | (2006.01) |
| *B63B 22/16* | (2006.01) |
| *A45B 23/00* | (2006.01) |

(52) U.S. Cl.

CPC ..... *A45B 11/00* (2013.01); *A45B 25/00* (2013.01); *A45B 2023/0006* (2013.01); *A45B 2025/003* (2013.01); *B63B 22/00* (2013.01); *B63B 22/16* (2013.01)

(58) Field of Classification Search

CPC ..... B63B 22/00; B63B 22/16; B63B 22/163; B63B 22/166; B63B 22/04; B63B 22/20

See application file for complete search history.

(56) References Cited

U.S. PATENT DOCUMENTS

| | | | | |
|---|---|---|---|---|
| 546,057 A | | 9/1895 | Richard | |
| 1,621,809 A | * | 3/1927 | Petersen | B63B 22/02 114/230.24 |
| 1,764,852 A | | 6/1930 | Phillips | |

(Continued)

FOREIGN PATENT DOCUMENTS

| | | |
|---|---|---|
| DE | 1951232 | 12/1966 |
| DE | 2944330 A1 | 5/1981 |

(Continued)

OTHER PUBLICATIONS

International Search Report dated Feb. 18, 2016, in International Application No. PCT/DE2015/100319.

(Continued)

*Primary Examiner* — Andrew Polay
(74) *Attorney, Agent, or Firm* — Mark M. Friedman

(57) ABSTRACT

A buoyant support (1) for an object (2), with at least the following components: a floating body (3), an insertion sleeve (7) for holding the object (2) and a clamping device (4) with at least one upper-side clamping part (5) and at least one lower-side clamping part (6), Due to the modular construction, the support can be dismantled into its individual parts, in order to thus facilitate the transport thereof. The components of the support are dimensioned such that these can be easily accommodated and stowed in a carrying bag.

8 Claims, 7 Drawing Sheets

(56) References Cited

U.S. PATENT DOCUMENTS

Figure 1:
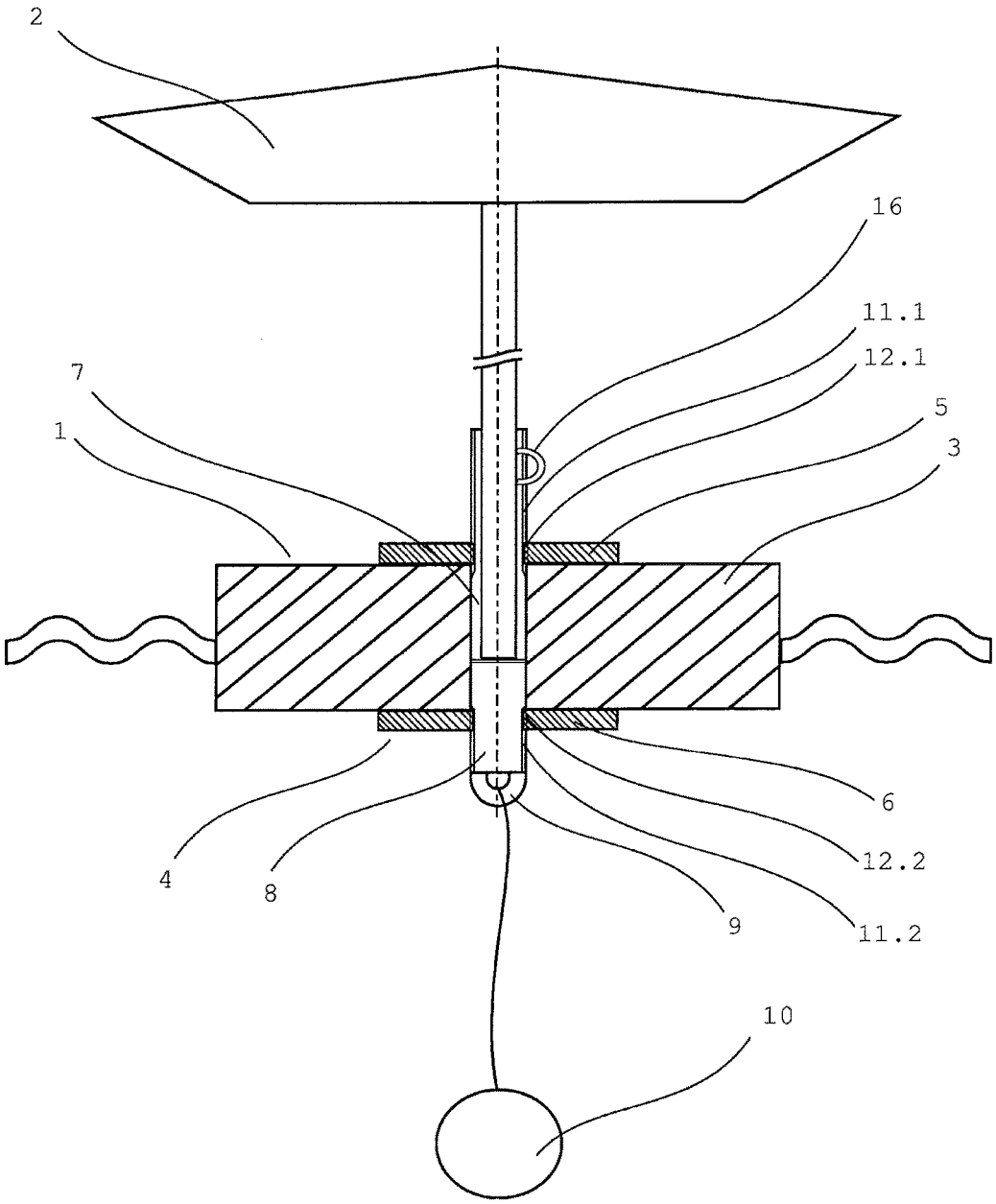

| | | | | |
|---|---|---|---|---|
| 2,911,658 | A * | 11/1959 | Stanley, Jr. | B63B 22/02 441/11 |
| 5,299,588 | A | 4/1994 | MacLeod | |
| 5,505,645 | A | 4/1996 | Engler | |
| 6,431,931 | B2 * | 8/2002 | Johnson | A01K 75/04 43/44.87 |
| 8,414,342 | B2 * | 4/2013 | Wille | B63B 27/24 405/195.1 |
| 2011/0057077 | A1 | 3/2011 | Johnson | |
| 2016/0106187 | A1 * | 4/2016 | Sloan | A45B 23/00 135/16 |
| 2017/0251774 | A1 | 9/2017 | D'Abundo | |

FOREIGN PATENT DOCUMENTS

| | | |
|---|---|---|
| DE | 102010026227 | 8/2011 |
| DE | 102014011481 | 2/2016 |
| FR | 2786156 | 5/2000 |
| FR | 2786156 A1 | 5/2000 |
| GB | 1020199 A | 2/1966 |

OTHER PUBLICATIONS

German Patent Office, Decision to Grant application DE10 2014 011 481.3, dated Feb. 26, 2019. English summary attached as Transmittal Letter.

* cited by examiner

BUOYANT SUPPORT FOR AN OBJECT

The invention relates to a buoyant support for an object having the features according to Claim 1.

Bathing islands and pontoons of different sizes which, in their simplest form, serve as a lying surface or resting place on a body of water or, in larger enlargements, are able to carry installations ranging from slides right up to event constructions, are known from the prior art. Said pontoons can be equipped with sunshades in order to shade the users.

These bathing islands or pontoons are less suitable for private use due to their size. On the one hand, they are costly and, on the other hand, they cannot be transported by car or by bicycle or on foot due to their size and complexity. Private individuals therefore cannot take them along with them during an excursion to a bathing lake.

A simple bathing island is described in FR 2 786 156 A1, which consists of a floating body in which an opening for receiving a sunshade is provided. The disadvantage of said bathing island is that it has to be anchored.

Supports for parasols for shading pool installations are known from the prior art, which supports are, however, firmly anchored in the ground. For example, such a support for a parasol can be inferred from US 2011/0057077 A1.

U.S. Pat. No. 5,505,645 discloses a buoyant support for, amongst other things, sunshades, in which the floating body is connected to a tubular pole, into which the shaft of the sunshade is inserted and which guarantees that the floating body can move and tilt under wave action while the pole and the shade remain upright. On the upper side of the floating body, a beverage tray is placed, which has a semi-spherical protuberance on the underside having a sleeve through which the pole is passed. On the upper side, the sleeve abuts a ring in the form of a crosspiece, which projects beyond the diameter of the sleeve, said ring being fastened to the pole and resting on the sleeve.

On the lower side of the floating body, there is, slidingly supported on the pole, an upwardly tapering collar which, if necessary, can be pushed into the conical opening of the floating body, in order to reduce or completely prevent movability between the pole and the floating body. Below the floating body there is a weight which acts as a counter-weight for stabilization purposes located at the bottom of the pole.

A buoyant support for a sunshade, in which the sunshade is inserted into a recess in the floating body, is known from U.S. Pat. No. 5,299,588. Alternatively, a metal plate bearing the sunshade can be strapped onto a tire tube by means of bands.

The object of the invention is to indicate a support for an object, in particular for a sunshade, which is buoyant and, in addition, lightweight and portable so that it can be carried by anyone in their luggage.

In order to achieve the object, a buoyant support for an object, in particular for a sunshade, is indicated which comprises at least as components on the device side: a floating body, an insertion sleeve for holding the object and a clamping device with at least one upper-side clamping part and at least one lower-side clamping part.

These clamping parts each have at least one clamping surface, wherein each clamping surface is planar on the floating body and wherein the floating body is clamped between the clamping surface of the at least one clamping part arranged on the upper side of the floating body and the clamping surface of the at least one clamping part arranged on the lower side of the floating body. The insertion sleeve, starting from the upper side of the support, is passed through the clamping device and protrudes on the bottom side from the clamping device. At least one means for fastening a lowering weight is provided on the lower-side clamping part and/or on the end of the insertion sleeve, which protrudes from the clamping device on the bottom side. The distinguishing feature of the support is that the components can be releasably connected to one another so that the support can be assembled in a modular manner from the components and dismantled back into the components thereof. The advantageous aspect of the support according to the invention is that, due to the modular construction, said support can be dismantled into its individual parts, in order to thus facilitate the transport thereof. The components of the support are dimensioned such that these can be easily accommodated and stowed in a carrying bag. In order to save weight, some or all of the components of the clamping device can be produced from lightweight, weather-proof and durable plastic. The floating body is preferably an air-filled closed body, in particular made of plastic. Such an air-filled floating body can, for example, be an air cushion which is designed in terms of its shape and size such that it guarantees adequate stability of the object located in the support. Such an air-filled floating body preferably has a sealable opening, via which air can be filled and let out again. Alternatively, the floating body can be manufactured from foamed plastics such as, for example, from polystyrenes.

The objects held can be held in a floating manner above the water by means of the buoyant support. The term "object" includes all of the products which need to be fixed above the water surface. In addition to sunshades, possible objects include, amongst others, fishing rods, flags or mast poles. However, this list is not exhaustive.

If the support is used as a sunshade stand, it is henceforth possible to provide sufficient shade to the bathers even at a great distance from the shore or the edge of the pool, which is advantageous at those times when the sun is particularly intense.

The support is preferably equipped with at least one upwardly open container, in particular a holding container such as a drinks cooler or drinks holder, wherein the container is designed to be fitted or pushed onto the clamping device or the insertion sleeve. In particular, the container comprises a continuous guide pipe extending vertically to the insertion sleeve, through which the object, for example the stanchion of the sunshade, can be passed right into the insertion sleeve. By providing other functional accessories such as hooks or even resting surfaces, the possibilities for using the support according to the invention can be further extended.

In addition, one or more troughs can be provided in the upper-side region of the floating body, said troughs being adapted to receive or store small objects such as, for example, drinks cans or bottles, glasses or cups.

The basic body of the support consists of a floating body which is preferably designed in the form of a disc-shaped pontoon. In an alternative embodiment, the floating body can be designed to be annular, in particular in the form of a circular ring.

The floating body is releasably clamped between a clamping surface of the at least one clamping part arranged on the upper side of the floating body and a clamping surface of the at least one clamping part arranged on the lower side of the floating body, but is substantially immovably clamped in the clamped state in order to produce a play-free and wobble-free fixing of the floating part between the clamping parts. The clamping parts are preferably plate-shaped or disc-shaped and rest in a mounted condition completely on the upper side and/or the lower side of the floating body.

In a particular embodiment, the clamping parts are adapted to the surface form of the floating body. In the case of an annular configuration of the floating body, the edge and/or end regions of the clamping parts engage over the top of or encompass the floating body ring, in the manner of a respective clamping surface. A buoyant support having an annular floating body preferably includes one or more spacers for spacing apart the upper-part and the lower-part clamping parts, said spacer(s) either being inserted between the clamping parts or connected to a clamping part.

The clamping parts have one or more means to connect the clamping parts, by means of which these can be releasably connected to one another and by means of which the necessary clamping force for fixing the floating body between the clamping surfaces is produced. This is preferably effected by means of a screw or plug-in connection. Alternatively, the clamping parts can be connected to one another by means of a clamping closure.

The insertion sleeve serves to receive the object, in particular to receive a sunshade, wherein the latter is introduced into the insertion sleeve.

The insertion sleeve is releasably connected to the clamping device, wherein the clamping device and, where appropriate, the floating body clamped in the clamping device comprise(s) a continuous recess, through hole or bore from the upper side to the lower side of the support, through which the insertion sleeve is passed. The recess, through hole or bore is preferably designed to fit the insertion sleeve.

In a preferred embodiment, the insertion sleeve is designed so that it can be connected to the at least one upper-side and/or to the at least one lower-side clamping part of the clamping device, and forms the connecting means for connecting the clamping parts, wherein the insertion sleeve and the at least one clamping part are each equipped with a connecting means and the connecting means are configured so as to correspond to one another. Such connecting means can be screw connections, clamp connections or plug-in connections.

In the simplest embodiment, the clamping device consists of an upper-side clamping part and a lower-side clamping part, which are each designed to be disc-shaped or plate-shaped, and a tubular insertion sleeve, wherein the clamping parts each comprise an opening having an internal thread centrically/centrally and the insertion sleeve is either equipped on the outer wall with a continuous external thread or, in the end regions thereof, is equipped in each case with separate external threads.

The floating body comprises, in this embodiment, a preferably centrically positioned, continuous bore, into which the insertion sleeve is inserted. One clamping part is then screwed respectively onto the upper side and lower side of the insertion sleeve and is rotated so far against the floating body that the latter is clamped between the clamping parts.

Alternatively, the head portion (upper-side region) of the insertion sleeve or the end region (lower-side region) of the insertion sleeve can be flatly connected to the respective clamping part. In this alternative embodiment, after inserting the insertion sleeve with the clamping part into the bore of the floating body, the mating clamping part is screwed onto the free end of the insertion sleeve and, as a result, the floating body is clamped between the clamping parts.

The buoyancy, the center of gravity, and the dimensions of the support are selected in such a way that the support floats with an inserted object on the water surface.

In an alternative embodiment, the buoyant support for an object comprises at least one floating body which is equipped with at least one recess extending from the upper side thereof to the lower side thereof, and an insertion sleeve passed through the recess in order to receive the object, wherein the insertion sleeve is releasably connected to the floating body and protrudes from the floating body on the bottom side, and wherein at least one means for fastening a lowering weight is provided on the end of the insertion sleeve, which protrudes from the floating body on the bottom side. In this embodiment, the insertion sleeve is directly connected to the floating body, preferably by means of a threaded screw connection.

If the objects are particularly tall or bulky, the fact that the center of gravity is too high may nonetheless cause the support including the object to tip.

In an extended embodiment, the support according to the invention therefore includes at least one lowering weight which is connected to the means for fastening a lowering weight provided on the lower-side clamping part and/or on the end of the insertion sleeve, which protrudes from the clamping device on the bottom side. In the simplest form, the means for fastening a lowering weight is a continuous bore or eyelet in the end region of the insertion sleeve. Likewise, the means for fastening a lowering weight may be part of a more complex connection system such as a screw connection or a click or connect system. The connection between the connecting means can have a rigid or movable design.

A lowering weight preferably consists of a solid body fastened to a rope or a chain, but also to a pole, wherein the end of the rope, the chain or the pole or a connecting means located there, is connected to the means for fastening a lowering weight.

The additional equipping of the support according to the invention with a lowering weight serves to displace the center of gravity downwards and thus stabilize the support against tipping.

The length of the rope, the chain or pole is preferably designed such that the solid body does not come to rest on the surface of the body of water or pool. The support preferably comprises a set of ropes, chains or poles which are of differing lengths or extendable, as well as solid bodies of different weights, as a result of which the taring of the support can be effected in accordance with the local conditions and as a function of the required displacement of the center of gravity.

In a particular embodiment, the weight of the solid body can be manually adjusted. The solid body can therefore comprise a fixed, preferably waterproof sleeve, into which sandy, gravelly or pebbly, or even liquid materials, can be filled, for example. The advantage of this configuration is that the sleeve can be filled directly on the beach with available materials, significantly reducing the weight of the lowering weight for transporting to or from the water.

In an extended embodiment of the support according to the invention, the support is equipped with a ground anchor which can be releasably connected to the clamping device or to the end of the insertion sleeve, which protrudes from the clamping device on the bottom side. To this end, the clamping device or the end of the insertion sleeve, which protrudes from the clamping device on the bottom side as well as the head portion of the ground anchor, comprise corresponding connecting means such as, for example, screw or plug-in connecting elements, by means of which these components can be connected to one another.

The buoyant support can also be modified for use on land by providing a ground anchor. The floating body clamped in the clamping device serves as a support part on the bottom surface, as a result of which the support is stabilized against tipping.

In order to connect the ground anchor with the end of the insertion sleeve, which protrudes from the clamping device on the bottom side, the ground anchor preferably comprises an axial bore in the head portion, which axial bore is equipped with a thread on the internal wall so that the ground anchor can be screwed onto an external thread located at the end of the insertion sleeve.

In a preferred embodiment, the head portion of the ground anchor is configured as a lower-side clamping part or the lower-side clamping part is firmly connected to the head portion of the ground anchor.

In another embodiment, the head portion of the ground anchor additionally comprises an external thread, onto which a lower-sided clamping part can be screwed in order to clamp the floating body.

Furthermore, the buoyancy of the buoyant support can be adjusted, wherein there is provided in the floating body at least one cavity which is designed in such a way that it can be filled or flooded.

By filling one or more cavities, for example with a sandy or liquid material, it is possible to displace the center of gravity of the buoyant support depending on the object inserted, in order to stabilize its position on the surface of the water.

Figure 2:
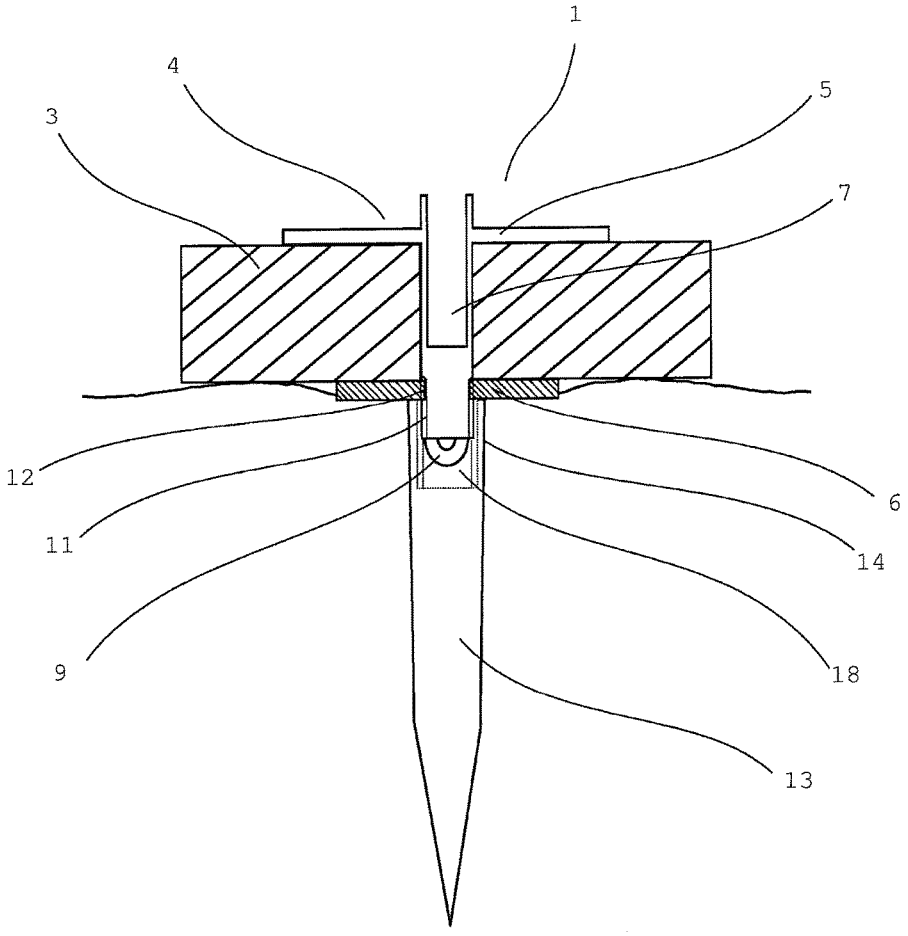
Figure 3:
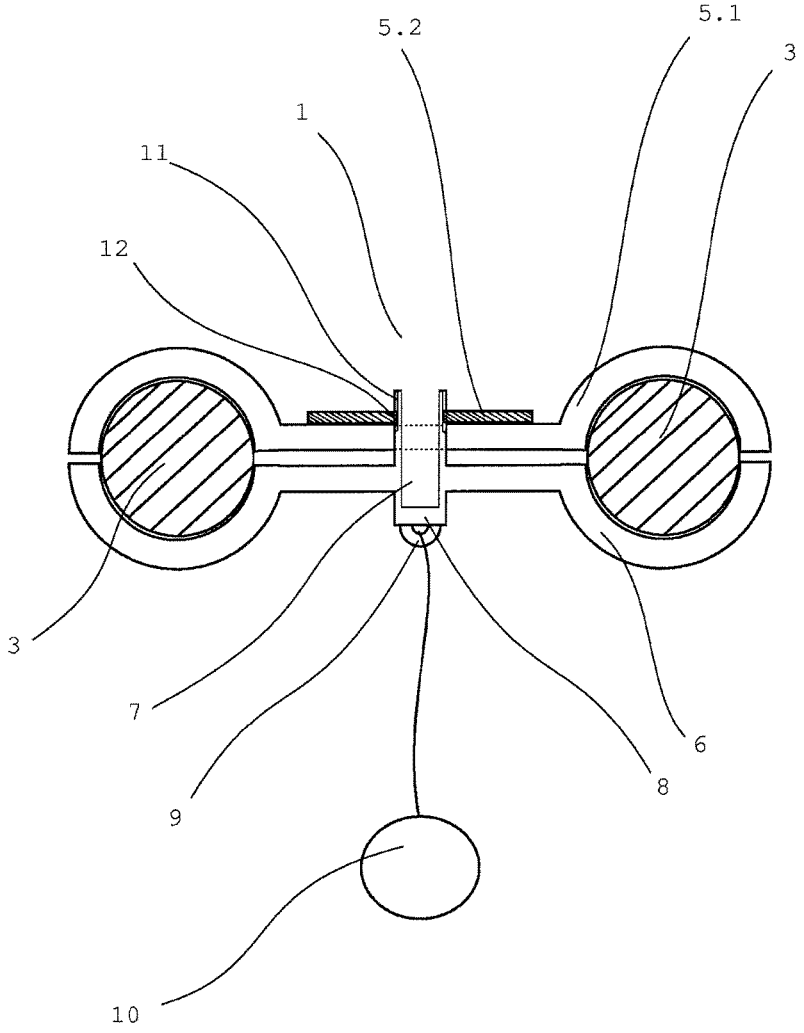
Figure 4:
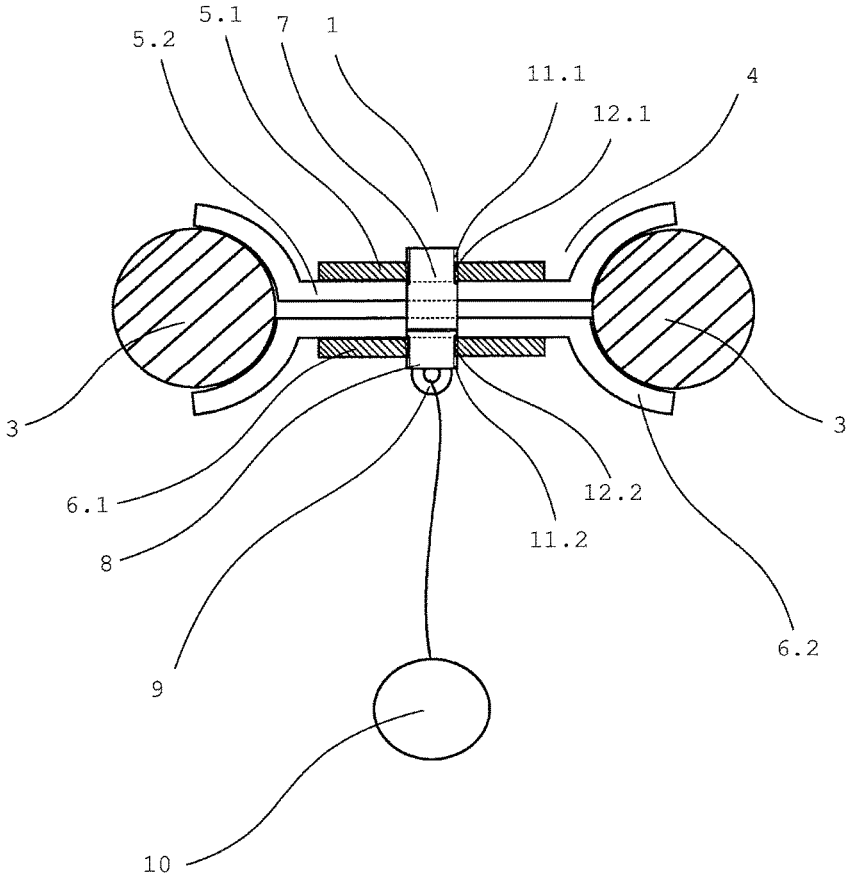
Figures 1, 5:
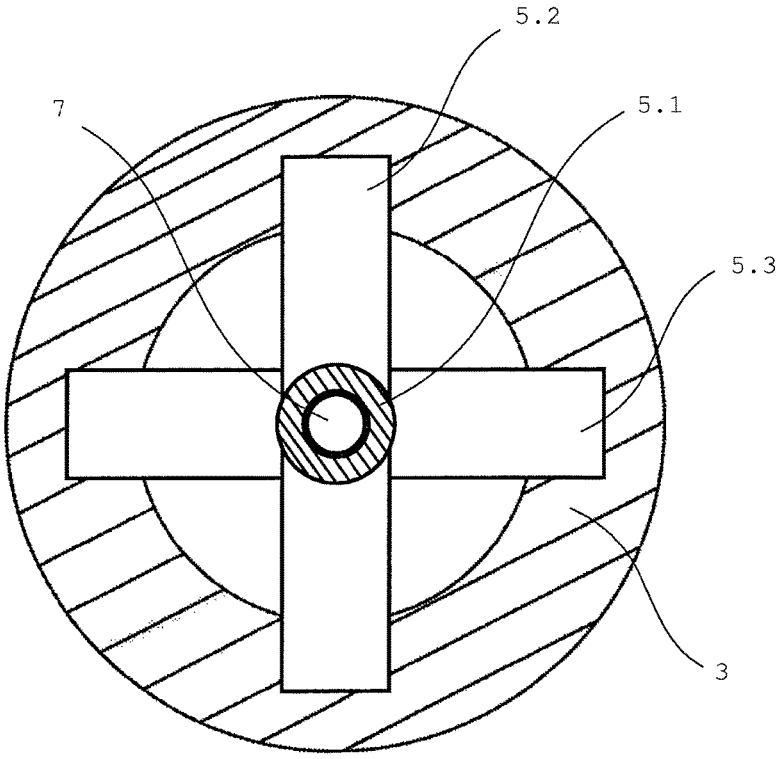
Figures 2, 5:
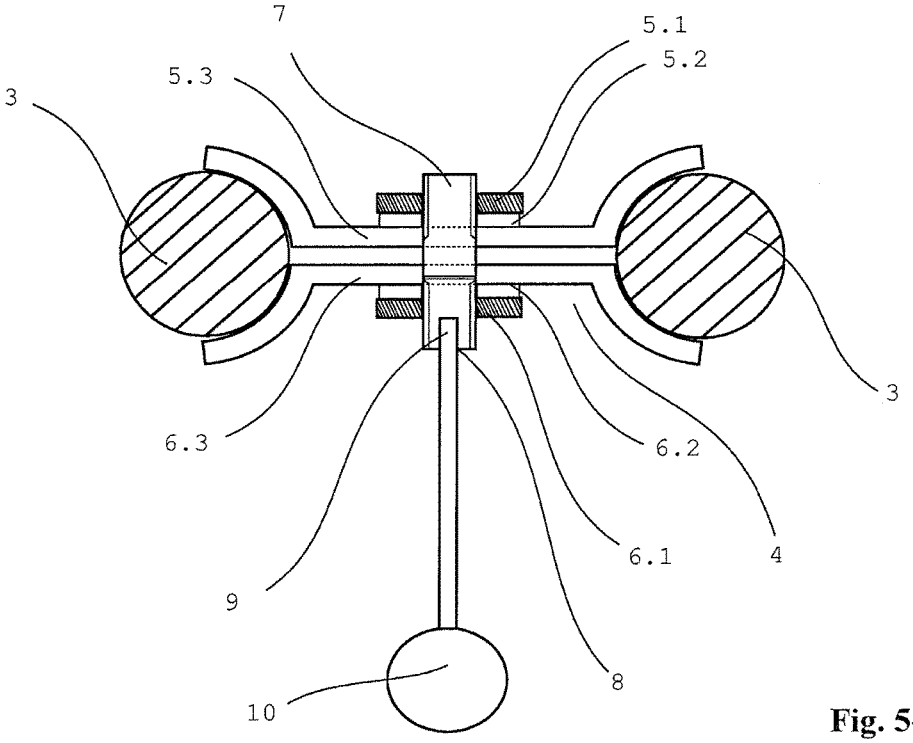
Figure 6:
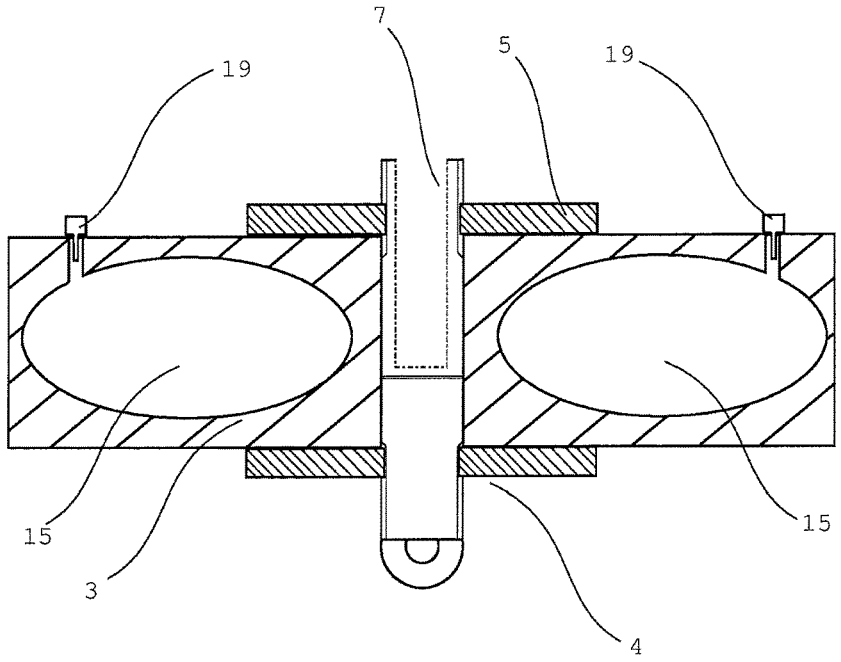
Figure 7:
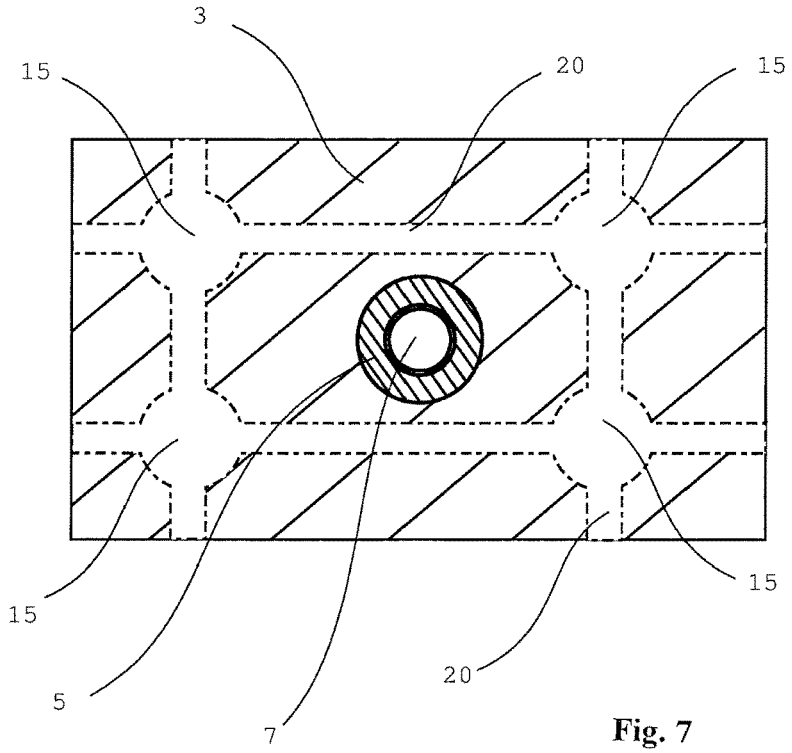
Figure 8:
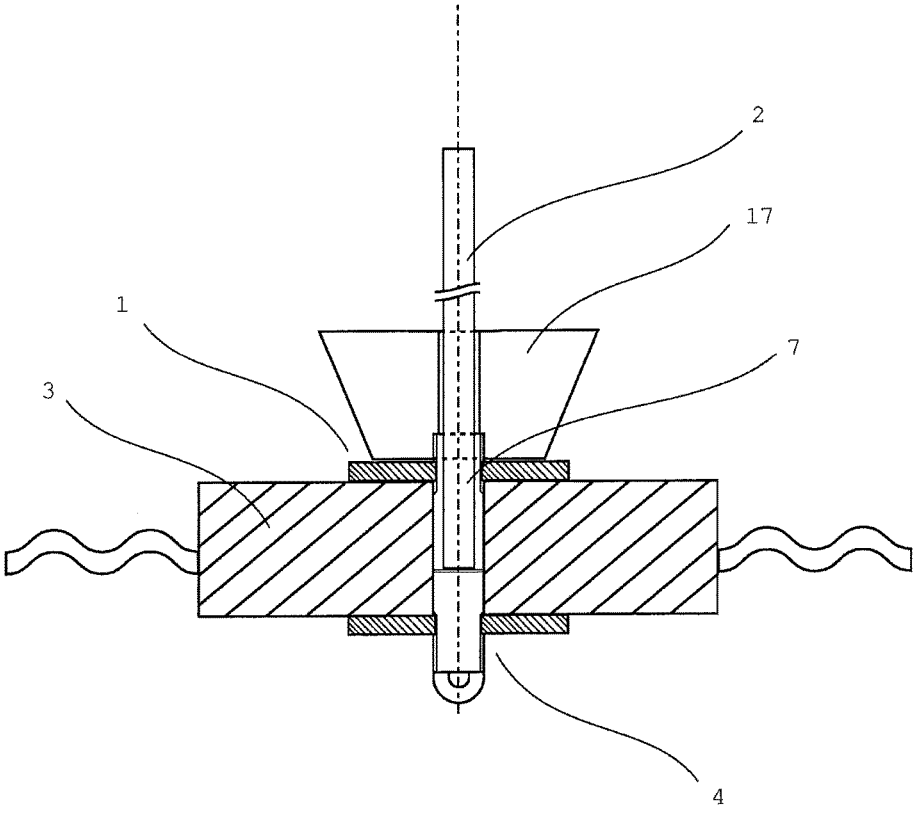

In order to fix the object in the insertion sleeve, the insertion sleeve can comprise a device for locking the object. The invention is explained in further detail below with reference to seven embodiment examples, wherein:

FIG. 1: shows a cross-sectional view of a first embodiment of the buoyant support having a floating body in the form of a pontoon and an inserted sunshade, FIG. 2: shows a cross-sectional view of a second embodiment of the buoyant support having a floating body in the form of a pontoon and a ground anchor, FIG. 3: shows a cross-sectional view of a third embodiment of the buoyant support having an annular floating body and a lowering weight, FIG. 4: shows a cross-sectional view of a fourth embodiment of the buoyant support having an annular floating body and a lowering weight, FIG. 5.1: shows a plan view of a fourth embodiment of the buoyant support having plate-shaped clamping parts and an annular floating body, FIG. 5.2: shows a cross-sectional view of the buoyant support in accordance with FIG. 5.1, FIG. 6: shows a cross-sectional view of the first embodiment of the buoyant support having a floating body in the form of a pontoon with cavities which are designed in such a way that they can be filled, FIG. 7: shows a plan view of the first embodiment of the buoyant support having a floating body in the form of a pontoon with cavities which are designed in the form of channels, and FIG. 8: shows a cross-sectional view of the first embodiment of the buoyant support having a floating body in the form of a pontoon and a container.

FIG. 1 shows a first embodiment of the buoyant support 1, in which the floating body 3 comprises the form of a disc-shaped pontoon and the clamping device 4 consists of two disc-shaped clamping parts 5, 6 and an insertion sleeve 7 and is adjusted to fix a sunshade 2. The stanchion of the sunshade 2 is introduced into the insertion sleeve and fixed in the insertion sleeve 7 by means of a spring lock 16.

A continuous bore passes centrally through the disc-shaped floating body 3, through which the insertion sleeve 7 is passed and protrudes at the upper and lower sides from the floating body 3. A clamping part 5, 6 is screwed onto each of the upper-side and lower-side ends 8 of the insertion sleeve 7, wherein the opposite ends of the insertion sleeve 7 each comprise an external thread 11.1 and 11.2 and the clamping parts each comprise an internal thread 12.1 and 12.2 in their central bore. The clamping parts 5, 6 are screwed onto the ends of the insertion sleeve 7 so far that these rest on the upper and lower sides respectively of the floating body 3 and, as a result, the floating body 3 is clamped between the clamping parts 5, 6.

An eyelet 9 for fastening the lowering weight 10, consisting of a solid body fastened to a rope, is provided at the end 8 of the insertion sleeve 7, which protrudes from the clamping device 4 on the bottom side.

FIG. 2 shows the support 1 according to the invention in a second embodiment, in which the upper clamping part 5 and the insertion sleeve 7 are configured as one component. On the lower side the clamping device 4 comprises a clamping part 6, which is screwed onto the end 8 of the insertion sleeve 7, which protrudes on the bottom side, by means of the threads 11 and 12 against the lower side of the floating body 3.

The support 1 according to the invention has been modified for use on land by joining a ground anchor 13 to the end 8 of the insertion sleeve 7 on the bottom side. The floating body 3 clamped in the clamping device 4 hereby serves as a support part on the ground surface, stabilizing the support 1 against tipping.

In order to connect the ground anchor 13 to the end 8 of the insertion sleeve 7, which protrudes from the clamping device 4 on the bottom side, the ground anchor 13 comprises in the head portion 14 thereof an axial bore 18 which is equipped on its internal wall with a thread so that the ground anchor 13 can also be screwed to the external thread 11 located at the end 8 of the insertion sleeve 7.

FIG. 3 shows a cross-sectional view of a third embodiment of the buoyant support 1 having an annular floating body 3 and a lowering weight 10.

In this embodiment of the support 1 according to the invention, the lower clamping part 6 and the insertion sleeve 7 are configured as one component. On the upper side, the clamping device 4 comprises two clamping parts 5.1 and 5.2. The clamping parts 5.1 and 6 are formed in their end regions in such a way that the annular floating body 3 is grasped by the end regions of the clamping parts 5.1 and 6 which are adapted to the cross-sectional form of the floating body 3. Above the upper-side clamping part 5.1, which is simply inserted by means of the insertion sleeve, a clamping part 5.2 is provided that can be screwed to the insertion sleeve 7 by means of the threaded joint 11, 12 and by means of which the clamping parts 6 and 5.1 as well as the annular floating body 3 located therebetween are clamped together.

FIG. 4 shows a support 1 having a clamping device 4 and an annular floating body 3 as well as a lowering weight 10, in which the clamping parts 5.2 and 6.2 are formed in their end regions in such a way that the annular floating body 3 is enclosed in the inner region of the circular ring by the end regions of the clamping parts 5.2 and 6.2 that are adapted to the cross-sectional form of the floating body 3. In order to clamp the clamping parts 5.2 and 6.2 and the annular floating body 3 located therebetween, a clamping part 5.1 or 6.1 was screwed on each side (on the upper side/lower side) from the outside to the insertion sleeve 7 by means of the threaded joint 11.1, 12.1 and 11.2, 12.2 respectively.

An extended embodiment of the support 1 in accordance with FIG. 4 is shown in FIGS. 5.1 and 5.2, in which further clamping parts 5.3 and 6.3 respectively are additionally provided on each of the upper and lower sides, said clamping parts 5.2 and 6.3 being aligned perpendicularly to the clamping parts 5.2 and 6.3, in order to achieve additional stabilization of the connection of the clamping device 4 and annular floating body 3.

The lowering weight 10 is connected by means of the pole to the connecting means 9 located on the end 8 of the insertion sleeve 7 on the bottom side by means of a plug-in connection, wherein it constitutes a releasable, but rigid connection between the connecting means.

FIGS. 6 and 7 show variants in which, in order to adjust the buoyancy of the support 1, cavities 15 are provided in the floating body 3.

In the embodiment in accordance with FIG. 6 of a support according to FIG. 6 1, two cavities 15 that can be filled with a sandy or liquid material are provided opposite one another in the floating body 3. The cavities can be sealed by means of the locks 19.

In the embodiment shown in accordance with FIG. 7 the cavities 15 of the floating body 3 are connected to one another by means of channels 20, wherein the channels 20 are open to the outside so that the cavities 15 can be flooded by means of the channels 20.

FIG. 8 shows a support 1 in accordance with FIG. 1, which is equipped with an upwardly open container 17 in the form of a drinks cooler, wherein the container 17 is inserted onto the clamping device 4 as well as the upper end of the insertion sleeve 7. In particular, the container 17 comprises a continuous guide tube 17 which extends vertically to the insertion sleeve 7, through which guide tube the stanchion of the sunshade 2 is passed right into the insertion sleeve 7.

The invention claimed is:

1. A buoyant support for an object, comprising at least as components:

a floating body, an insertion sleeve for holding the object and a clamping device with at least one upper-side clamping part and at least one lower-side clamping part, wherein the clamping parts each have at least one clamping surface which is planar on the floating body, wherein the floating body is clamped between the clamping surface of the at least one clamping part arranged on the upper side of the floating body and the clamping surface of the at least one clamping part arranged on the lower side of the floating body, wherein the insertion sleeve, starting from the upper side of the support, is passed through the clamping device and protrudes on the bottom side from the clamping device, wherein at least one connector for fastening a lowering weight is provided on the lower-side clamping part and/or on the end of the insertion sleeve, which protrudes from the clamping device on the bottom side, and wherein the components can be releasably connected to one another so that the support can be assembled in a modular manner from the components and can be dismantled back into the components thereof, wherein the clamping parts are plate shaped, wherein the opposing ends of the insertion sleeve are provided with a respective external thread, wherein the clamping parts are provided with an internal thread at the respective central bore thereof such that the clamping parts can be threaded onto the ends of the insertion sleeve such that the clamping parts lie on the upper and lower part of the floating body, and in this way the floating body is clamped between the clamping parts.

2. The buoyant support according to claim 1, wherein the support is equipped with at least one lowering weight, wherein at least one lowering weight is connected to the connector provided on the lower-side clamping part and/or on the end of the insertion sleeve, which protrudes from the clamping device on the bottom side.

3. The buoyant support according to claim 1, wherein a ground anchor is provided, which can be releasably connected to the clamping device or which can be releasably connected to the end of the insertion sleeve, which protrudes from the clamping device on the bottom side.

4. The buoyant support according to claim 3, wherein the head portion of the ground anchor is configured as the lower-side clamping part.

5. The buoyant support according to claim 1 wherein the buoyancy of the floating body can be adjusted, wherein there is provided in the floating body at least one cavity which is designed in such a way that it can be filled or flooded.

6. The buoyant support according to claim 1, wherein the insertion sleeve comprises a device for locking the object.

7. The buoyant support according to claim 1, wherein the support is equipped with at least one upwardly open container, wherein the container is designed to be fitted or pushed onto the clamping device or the insertion sleeve.

8. The buoyant support according to claim 1, wherein the object is a sunshade.

* * * * *